US011391117B2

(12) United States Patent
Acosta et al.

(10) Patent No.: US 11,391,117 B2
(45) Date of Patent: Jul. 19, 2022

(54) ANNULAR CASING PACKER COLLAR STAGE TOOL FOR CEMENTING OPERATIONS

(71) Applicant: Halliburton Energy Services, Inc., Houston, TX (US)

(72) Inventors: Frank Acosta, Spring, TX (US); Ben E. Dawsey, Albuquerque, NM (US)

(73) Assignee: Halliburton Energy Services, Inc., Houston, TX (US)

( * ) Notice: Subject to any disclaimer, the term of this patent is extended or adjusted under 35 U.S.C. 154(b) by 99 days.

(21) Appl. No.: 16/504,750

(22) Filed: Jul. 8, 2019

(65) Prior Publication Data

US 2021/0010345 A1 Jan. 14, 2021

(51) Int. Cl.
*E21B 33/14* (2006.01)
*E21B 33/16* (2006.01)
*E21B 33/072* (2006.01)

(52) U.S. Cl.
CPC ..... *E21B 33/146* (2013.01); *E21B 33/16* (2013.01); *E21B 33/072* (2013.01)

(58) Field of Classification Search
CPC ..... E21B 33/146; E21B 33/072; E21B 33/16
See application file for complete search history.

(56) References Cited

U.S. PATENT DOCUMENTS 3,524,503 A 8/1970 Baker
4,669,541 A * 6/1987 Bissonnette ..... E21B 33/146 166/154
5,048,611 A * 9/1991 Cochran ..... E21B 21/103 166/374
5,348,089 A * 9/1994 Brandell ..... E21B 33/146 166/154
2004/0040709 A1* 3/2004 Rogers ..... E21B 17/06 166/285
2006/0219441 A1* 10/2006 Telfer ..... E21B 17/22 175/325.7

(Continued)

FOREIGN PATENT DOCUMENTS

WO 2017/091246 A1 6/2017

OTHER PUBLICATIONS

International Search Report and Written Opinion issued in related PCT Application No. PCT/US2019/041106 dated Apr. 6, 2020, 10 pages.

*Primary Examiner* — Robert E Fuller
*Assistant Examiner* — Neel Girish Patel
(74) *Attorney, Agent, or Firm* — McAfee & Taft

(57) ABSTRACT

The present disclosure relates to multiple stage operations, and more particularly to systems and methods for performing second stage cementing operations with a stage tool. A stage tool comprises: a mandrel; an opening seat; a closing seat; a plurality of ports; a closing sleeve; and a packer element, wherein the opening seat is attached to an interior surface of the mandrel, wherein the closing seat is attached to the interior surface of the mandrel, wherein the plurality of ports is configured to allow fluid communication between the interior surface of the mandrel and an exterior surface of the mandrel, wherein the closing sleeve is disposed on the exterior surface of the mandrel and coupled to the closing seat, wherein the packer element is disposed on the exterior surface of the mandrel.

20 Claims, 4 Drawing Sheets

(56) References Cited

U.S. PATENT DOCUMENTS

| | | | | |
|---|---|---|---|---|
| 2010/0206572 | A1* | 8/2010 | Makowiecki | E21B 34/14 166/332.1 |
| 2012/0055681 | A1 | 3/2012 | Telfer | |
| 2013/0180731 | A1* | 7/2013 | Acosta | E21B 34/103 166/386 |
| 2013/0233572 | A1* | 9/2013 | Helms | E21B 33/146 166/387 |
| 2018/0058174 | A1* | 3/2018 | Yue | E21B 33/1204 |

* cited by examiner

ANNULAR CASING PACKER COLLAR STAGE TOOL FOR CEMENTING OPERATIONS

BACKGROUND

The present disclosure generally relates to multiple stage operations, and more particularly to systems and methods for performing cementing jobs with a stage tool.

In the drilling of deep wells, it is often desirable to cement the casing in the well bore in separate stages, beginning at the bottom of the well and working upward. During the drilling and construction of subterranean wells, casing strings are generally introduced into the wellbore. To stabilize the casing, a cement slurry is often pumped downwardly through the casing, and then upwardly into the annulus between the casing and the walls of the wellbore. One concern in this process is that, prior to the introduction of the cement slurry into the casing, the casing generally contains a drilling or some other servicing fluid that may contaminate the cement slurry. To prevent this contamination, a subterranean plug, often referred to as a cementing plug or a "bottom" plug, may be placed into the casing ahead of the cement slurry as a boundary between the two. The plug may perform other functions as well, such as wiping fluid from the inner surface of the casing as it travels through the casing, which may further reduce the risk of contamination.

Similarly, after the desired quantity of cement slurry is placed into the casing, a displacement fluid is commonly used to force the cement into the desired location. To prevent contamination of the cement slurry by the displacement fluid, a "top" cementing plug may be introduced at the interface between the cement slurry and the displacement fluid. This top plug also wipes cement slurry from the inner surfaces of the casing as the displacement fluid is pumped downwardly into the casing.

In some circumstances, a pipe string will be placed within the wellbore by a process comprising the attachment of the pipe string to a tool (often referred to as a "casing hanger and run-in tool" or a "work string") which may be manipulated within the wellbore to suspend the pipe string in a desired sub-surface location. In addition to the pipe string, a sub-surface release cementing plug system comprising a plurality of cementing plugs may also be attached to the casing hanger and run-in tool. Such cementing plugs may be selectively released from the run-in tool at desired times during the cementing process. Additionally, a check valve, typically called a float valve, will be installed near the bottom of the pipe string to perform the first stage operation. The float valve may permit the flow of fluids through the bottom of the pipe string into the annulus, but not the reverse. A cementing plug will not pass through the float valve.

In conventional second stage operations, sleeves are individually shifted via plugs. Subsequently, packer elements can expand due to available hydraulic pressure from the shifting sleeves. However, this can be costly and time-consuming to drop a plug for each desired operation. For example, incorrect plugs may be inadvertently used or operator error may occur in the release/launch of the proper plug at the appropriate time. Further, rupture discs covering ports within conventional cementing tools can be prematurely actuated when there are pressure losses within the tool, thereby allowing access between the exterior and interior of the cementing tool during non-ideal conditions.

BRIEF DESCRIPTION OF THE DRAWINGS

These drawings illustrate certain aspects of some of the embodiments of the present disclosure and should not be used to limit or define the claims.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure generally relates to multiple stage operations, and more particularly to systems and methods for performing cementing jobs with a stage tool. While conventional stage tools for cementing operations may actuate the packer element to set, expand or both based on a pressure differential between the interior and exterior of the stage tool, the present disclosure contemplates a stage tool that may be configured to mechanically set, expand or both a packer element by transmitting the load after a setting plug has landed on a setting seat. Further, the disclosed stage tool may eliminate the need for rupture disks disposed about the ports of the stage tool. There may be risks of prematurely puncturing rupture disks while disposing conventional stage tools downhole. The disclosed stage tool may provide for setting a packer at a predetermined pressure with fewer seats and plug drops necessary for conventional tooling. As the seats in the disclosed stage tool shift or translate within the stage tool, there may be confirmation at the surface determined by changes in fluid pressure. The disclosed stage tool may provide cost savings in reduced equipment within the tool, reduce risk of prematurely puncturing rupture disks by eliminating the need for such use, and provides for reduced time during operations as fewer plug drops are necessary.

Figure 1:
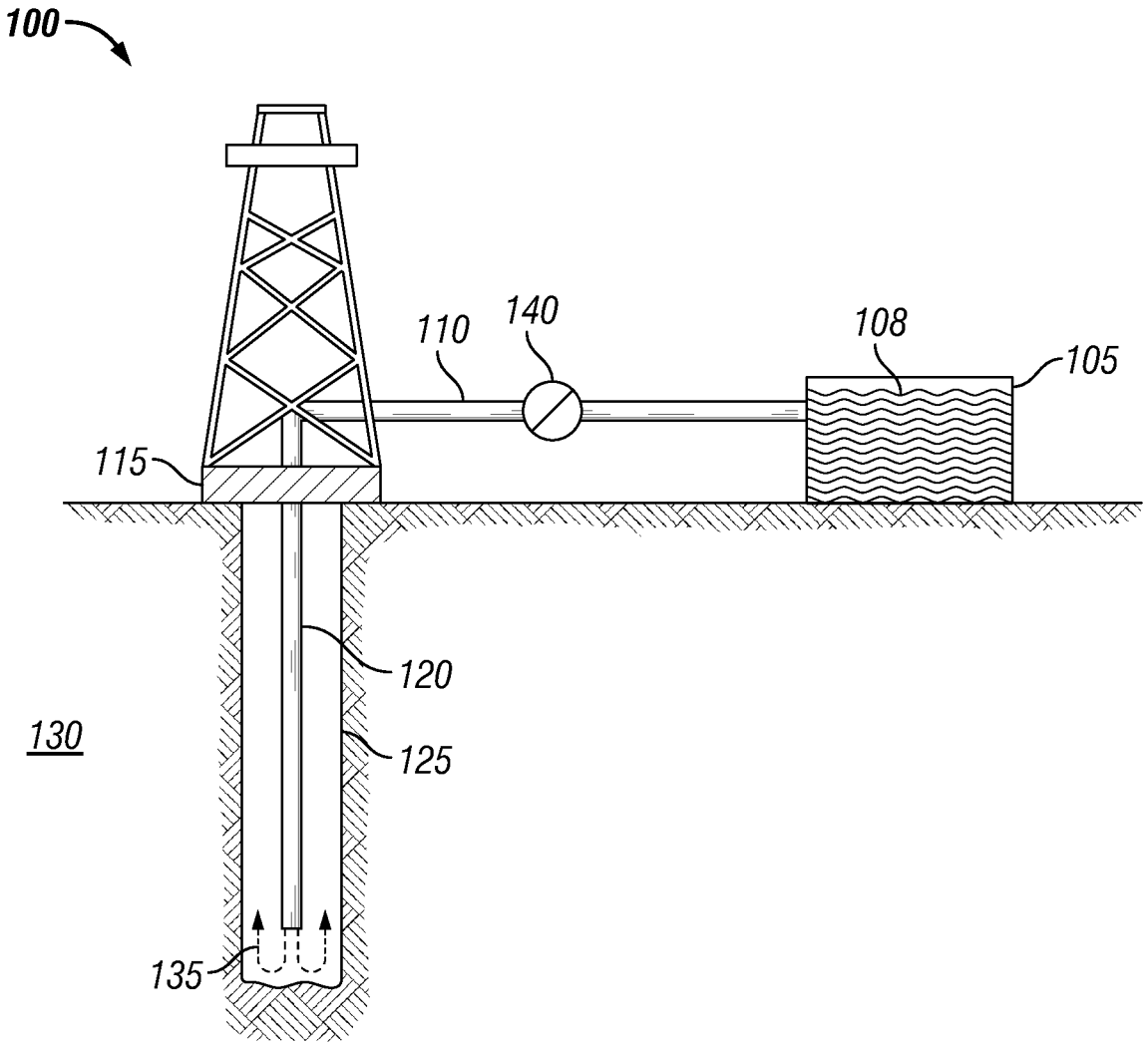
FIG. 1 illustrates a system configured for delivering cement slurries downhole in accordance with one or more embodiments of the present disclosure.
Figure 2:
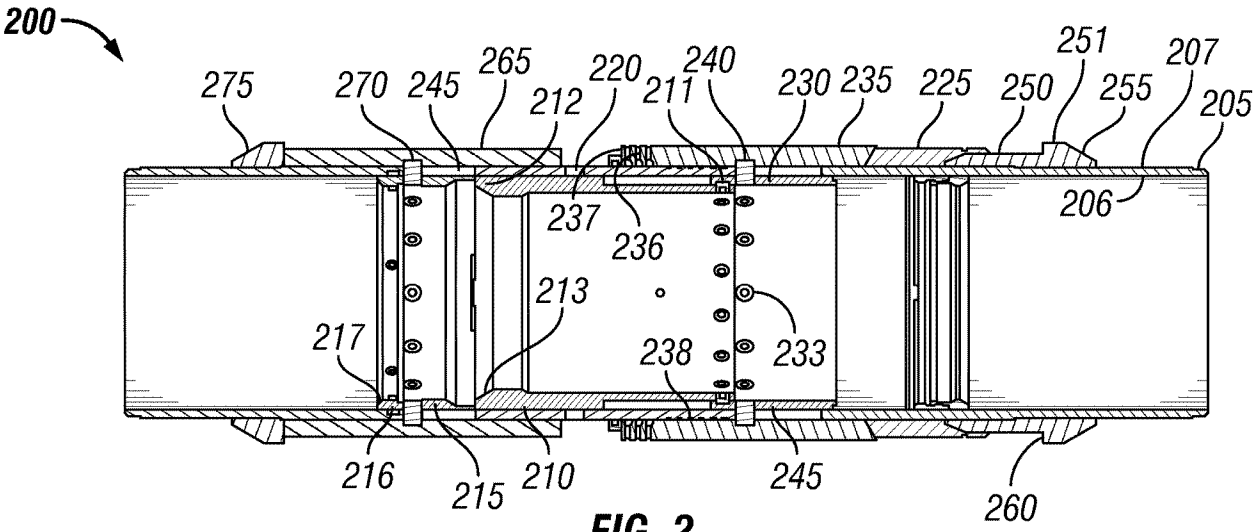
FIG. 2 illustrates a cross-sectional view of a cementing tool in a first position in accordance with one or more embodiments of the present disclosure.

FIG. 1 shows an illustrative schematic of a system 100 that can deliver cement slurries, according to one or more embodiments. It should be noted that while FIG. 1 generally depicts a land-based system, it is to be recognized that like systems may be operated in subsea locations as well. As depicted in FIG. 1, the system 100 may include a mixing tank 105, in which a cement slurry 108 may be formulated. Again, in one or more embodiments, the mixing tank 105 may represent, or otherwise be replaced with, a transport vehicle, a shipping container or both configured to deliver or otherwise convey the cement slurry 108 to the well site. The cement slurry 108 may be conveyed via a line 110 to a wellhead 115, where the cement slurry 108 enters a tubular 120 (for example, a casing, drill pipe, production tubing, coiled tubing, etc.). The tubular 120 may extend from the wellhead 115 into a wellbore 125 penetrating a subterranean formation 130. Upon being ejected from the tubular 120, the cement slurry 108 may subsequently return up the wellbore 125 in the annulus between the tubular 120 and the wellbore 125 as indicated by flow lines 135. In one or more embodiments, the cement slurry 108 or any other suitable fluid may be reverse pumped down through the annulus and up tubular 120 back to the surface, without departing from the scope of the disclosure. A pump 140 may be configured to raise the pressure of the cement slurry 108 to a desired degree before introduction of the cement slurry 108 into tubular 120 (or the annulus). It is to be recognized that the system 100 is merely exemplary in nature and various additional components may be present that have not necessarily been depicted in FIG. 1 in the interest of clarity. Non-limiting additional components that may be present include, but are not limited to, supply hoppers, valves, condensers, adapters, joints, gauges, sensors, compressors, pressure controllers, pressure sensors, flow rate controllers, flow rate sensors, temperature sensors, and the like.

One skilled in the art, with the benefit of this disclosure, may recognize the changes to the system 100 described in FIG. 1 to provide for other cementing operations (for example, squeeze operations, reverse cementing (where the cement is introduced into an annulus between a tubular and the wellbore and returns to the wellhead through the tubular), and the like).

It is also to be recognized that the cement slurry 108 may also directly, indirectly or both affect the various downhole equipment and tools that may come into contact with the treatment fluids during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (for example, shoes, collars, valves, etc.), wellbore projectiles (for example, wipers, plugs, darts, balls, etc.), logging tools and related telemetry equipment, actuators (for example, electromechanical devices, hydromechanical devices, etc.), sliding sleeves, production sleeves, plugs, screens, filters, flow control devices (for example, inflow control devices, autonomous inflow control devices, outflow control devices, etc.), couplings (for example, electro-hydraulic wet connect, dry connect, inductive coupler, etc.), control lines (for example, electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIG. 1.

Referring now to FIGS. 2, 3, 4 and 5, a stage tool 200 may be used for performing a cementing operation, other second stage operation or both in a multi-stage operation. Without limitations, the stage tool 200 may comprise an annular casing packer collar. The stage tool 200 may comprise a mandrel 205. In embodiments, the mandrel 205 may be any suitable size, height, shape and any combination thereof. The mandrel 205 may be a generally tubular element constructed of steel, aluminum, composite, other materials used in oilfield operations and any combination thereof.

Both an opening seat 210 and a closing seat 215 may be attached to an interior surface 206 of the mandrel 205. Such attachment may be made via any suitable fasteners. In embodiments, shear pins may be used thereby allowing selective movement of the respective elements relative to the mandrel 205. Movement of the opening seat 210 may uncover a port 220 to provide selective communication between the interior surface 206 and an exterior surface 207 of the mandrel 205. In embodiments, there may be a plurality of ports 220 disposed about the mandrel 205, wherein each one of the plurality of ports 220 spans the thickness of the mandrel 205, wherein the opening seat 210 blocks or covers the plurality of ports 220 from the interior surface 206 of the mandrel 205 in a first position (for example, a run-in position). The plurality of ports 220 may be disposed about the mandrel 205 in any suitable fashion, such as in a radial arrangement. Movement of the opening seat 210 may further allow for actuation of a packer element 225 attached to the exterior surface 207 of the mandrel 205. Movement of the closing seat 215 may cover the plurality of ports 220 preventing communication between the interior surface 206 and the exterior surface 207 of the mandrel 205.

The opening seat 210 may be constructed of any suitable materials, including, but not limited to, metals, nonmetals, polymers, composites, and/or combinations thereof. In embodiments, the opening seat 210 may be constructed of materials used in zonal isolation operations. The opening seat 210 may be disposed adjacent to the closing seat 215 in the first position. In the first position, the opening seat 210 may cover the plurality of ports 220 in the mandrel 205. Thus, fluid communication between the interior surface 206 and the exterior surface 207 of the mandrel 205 is prevented through the plurality of ports 220 when the opening seat 210 is in the first position. The opening seat 210 may have a first end 211 coupled to an intermediate sleeve 230, wherein the intermediate sleeve 230 is disposed about the interior surface 206 of the mandrel 205. The intermediate sleeve 230 may translate in-line with the translation of the opening seat 210. Without limitations, a plurality of shear pins 233 may couple the intermediate sleeve 230 to the first end 211 of the opening seat 210. The plurality of shear pins 233 may allow the intermediate sleeve 230 to move in tandem with the opening seat 210 until the plurality of shear pins 233 are sheared. After the plurality of shear pins 233 have been sheared, the intermediate sleeve 230 may translate in relation to the opening seat 210. In one or more embodiments, the intermediate sleeve 230 may translate in a direction parallel to further movement or translation of the opening seat 210.

In embodiments, the intermediate sleeve 230 may serve to transfer movement from the opening seat 210 to a setting sleeve 235 via suitable fasteners that couple said intermediate sleeve 230 to the setting sleeve 235. In one or more embodiments, the setting sleeve 235 may be disposed about the external surface 207 and around the mandrel 205. Without limitations, the suitable fasteners may be a plurality of radial setting pins 240. As illustrated, the plurality of radial setting pins 240 may be disposed in a first set of a plurality of outer channels 245 disposed about the mandrel 205. In one or more embodiments, each one of the plurality of radial setting pins 240 may be disposed in an individual outer channel 245, wherein each outer channel 245 spans the thickness of the mandrel 205. The length of the first set of the plurality of outer channels 245 may limit the distance that the opening seat 210 may travel as the ends of each one of the plurality of outer channels 245 prohibit further movement of the intermediate sleeve 235. In one or more embodiments, the setting sleeve 235 may be coupled to the intermediate sleeve 230 through the plurality of radial setting pins 240, wherein the setting sleeve 235 is configured to translate as the intermediate sleeve 230 translates.

Figure 3:
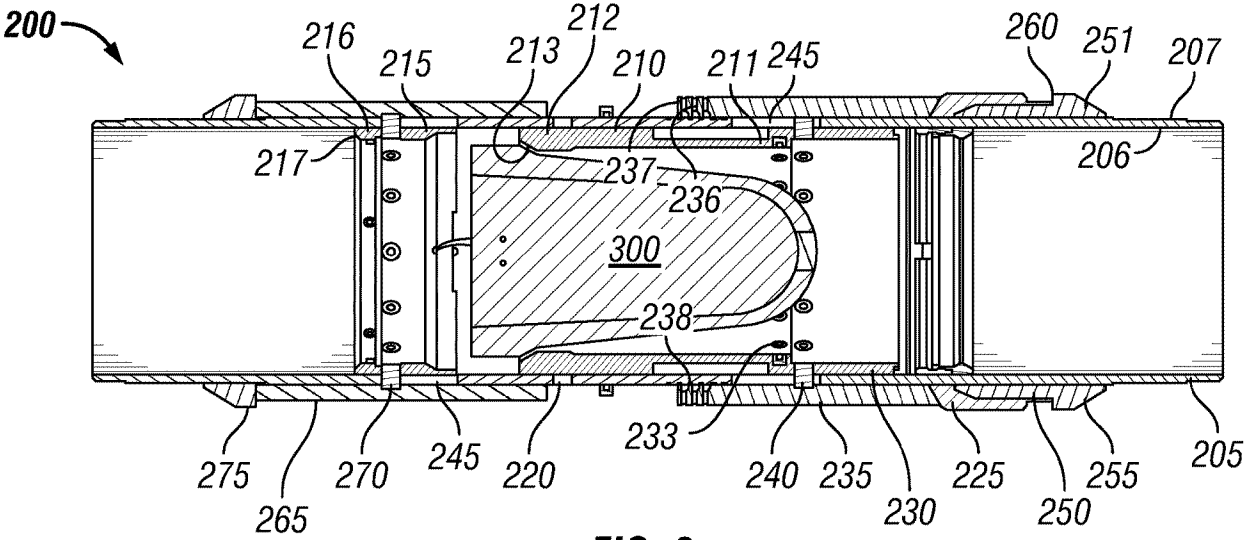
FIG. 3 illustrates a cross-sectional view of a cementing tool in a second position in accordance with one or more embodiments of the present disclosure.
Figure 4:
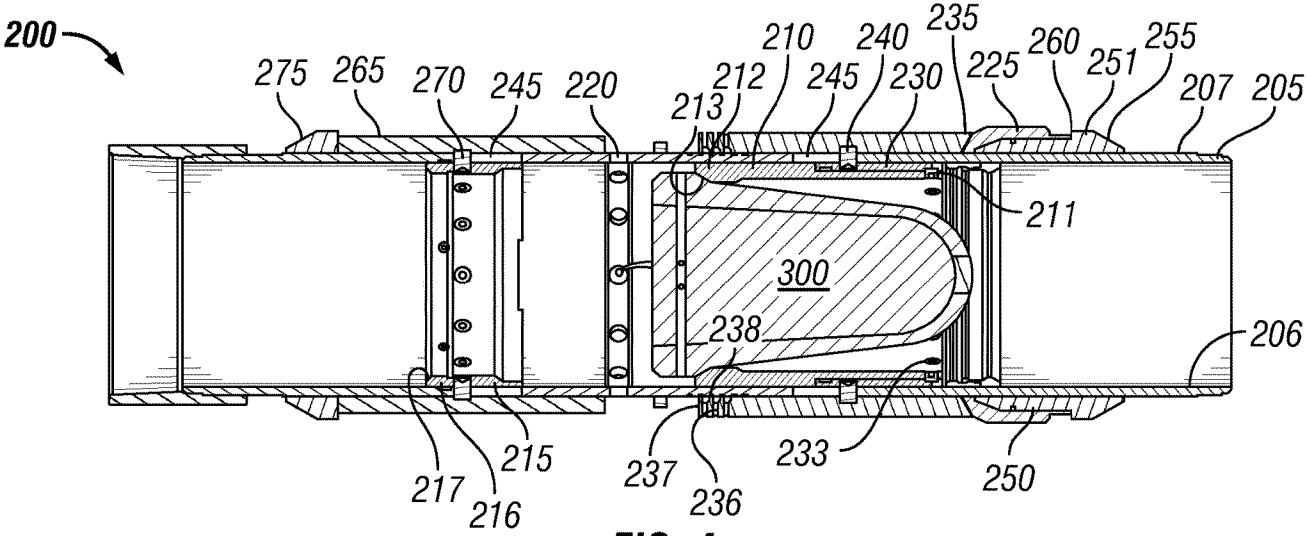
FIG. 4 illustrates a cross-sectional view of a cementing tool in a third position in accordance with one or more embodiments of the present disclosure.
Figure 5:
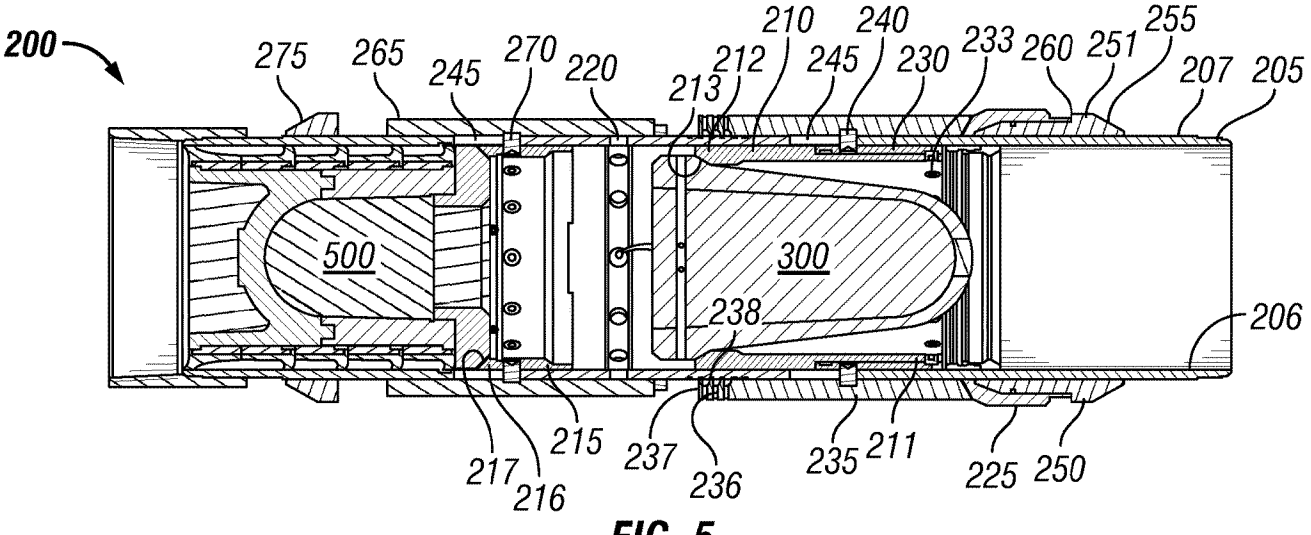
FIG. 5 illustrates a cross-sectional view of a cementing tool in a fourth position in accordance with one or more embodiments of the present disclosure.

The opening seat 210 may have a second end 212 with an interior surface 213 having a conical or other shape suitable for swallowing, seating, or otherwise engaging an opening plug 300 (shown in FIGS. 3-5). The opening plug 300 may have any suitable size, height, and/or shape to engage the opening seat 210. The opening plug 300 may be a plug, ball, dart, or other device for shifting and carrying any one or more seats downward. Without limitations, the opening plug 300 may be formed of aluminum, composite, rubber, or other materials used in multiple stage zonal isolation operations. When the opening plug 300 lands in the opening seat 210, the opening seat 210 may move from the first position to a second position by translating in an axial direction through the mandrel 205. In the second position, the opening seat 210 may no longer cover the plurality of ports 220. As the opening seat 210 moves, the packer element 225 may be actuated.

As illustrated, the packer element 225 may be attached to or disposed on the exterior surface 207 of the mandrel 102. While a singular packer element 225 is depicted, any number of packer elements 225 may be used within the scope of the present disclosure. In one or more embodiments, the packer element 225 may be disposed between the setting sleeve 235 and a ramp 250. The ramp 250 may be configured to expand the packer element 225 by providing an angle in relation to the exterior surface 207 of the mandrel 205. The ramp 250 may comprise a lower centralizer 255 at a distal end 251 of the ramp 250. The lower centralizer 255 may serve to centralize the stage tool 200 within a wellbore.

Once the opening plug 300 drops, the opening seat 210 may translate along the interior of the mandrel 205. Since the setting sleeve 235 is coupled to the opening seat 210, as the opening seat 210 translates, the setting sleeve 235 may translate accordingly. As the setting sleeve 235 translates, the packer element 225 may be compressed by the setting sleeve 235 and the ramp 250. Such compression may cause radial expansion of the packer element 225, allowing the packer element 225 to engage an interior surface (not shown) of the wellbore. The packer element 225 may be displaced over the ramp 250 and against a shoulder 260 of the lower centralizer 255. In this second position, the packer element 225 may be expanded and sealed against the interior surface of the wellbore and the plurality of ports 220 may be open to allow fluid communication between the interior surface 206 and the exterior surface 207 of the mandrel 205. As illustrated, the setting sleeve 235 may comprise one or more lock rings 236 disposed at a first end 237 of the setting sleeve 235. The one or more lock rings 236 may be configured to be received by one or more accommodating grooves 238 disposed on the exterior surface 207 of the mandrel 205. As the setting sleeve 235 translates and compresses the packer element 225, the setting sleeve 235 may be locked in place as the one or more lock rings 236 are displaced into the one or more grooves 238. In this position, the setting sleeve 235 may be inhibited from translating back to cover the plurality of ports 220. In order to prevent further fluid communication through the plurality of ports 220, a closing plug 500 (shown in FIG. 5) may be dropped to engage the closing seat 215 to cover the plurality of ports 220.

The closing seat 215 may be constructed of any suitable materials, including, but not limited to, metals, nonmetals, polymers, composites, and/or combinations thereof. In embodiments, the closing seat 215 may be constructed of materials used in zonal isolation operations. The closing seat 215 may be disposed adjacent and uphole to the opening seat 210 in a first position. In the first position (for example, a run-in position), the closing seat 215 may not cover the plurality of ports 220. Thus, fluid communication between the interior surface 206 and the exterior surface 207 of the mandrel 205 is permitted through the plurality of ports 220 when the closing seat 215 is in the first position and the opening seat 210 is in the second position. The closing seat 215 may be coupled to a closing sleeve 265 disposed about the external surface 207 and around the mandrel 205 via suitable fasteners, wherein the closing sleeve 265 may translate as the closing seat 215 translates. Without limitations, the suitable fasteners may be a plurality of radial closing pins 270. As illustrated, the plurality of radial closing pins 270 may be disposed in a second set of the plurality of outer channels 245 disposed about the mandrel 205. In one or more embodiments, each one of the plurality of radial closing pins 270 may be disposed in an individual outer channel 245 of the second set, wherein each outer channel 245 spans the thickness of the mandrel 205. The length of the second set of plurality of outer channels 245 may limit the distance that the closing seat 215 may travel as the ends of each one of the second set of plurality of outer channels 245 prohibit movement of the closing seat 215. Further, there may be an upper centralizer 275 disposed about and/or adjacent to the closing sleeve 265 in the first position on the exterior surface 207 of the mandrel 205. The upper centralizer 275 may serve to centralize the stage tool 200 within the wellbore. As the closing sleeve 265 translates, the closing sleeve 265 may abut the upper centralizer 275 wherein the upper centralizer 275, the second set of plurality of outer channels 245, or combinations thereof inhibit further translation in a certain direction.

The closing seat 215 may have a first end 216 with an interior surface 217 having a conical or other shape suitable for swallowing, seating, or otherwise engaging the closing plug 500 (shown in FIG. 5), wherein the closing seat 215 is configured to receive the closing plug 500 at the first end 216. The closing plug 500 may have any suitable size, height, and/or shape to engage the closing seat 215. The closing plug 500 may be a plug, ball, dart, or other device for shifting and carrying any one or more seats downward. Without limitations, the closing plug 500 may be formed of aluminum, composite, rubber, or other materials used in multiple stage zonal isolation operations. When the closing plug 500 lands in the closing seat 215, the closing seat 215 may move from the first position to a second position. As the closing seat 215 moves to the second position, the closing sleeve 265 may translate accordingly. When the closing seat 215 has moved to the second position, the closing sleeve 265 may cover the plurality of ports 220, thereby inhibiting fluid communication between the interior surface 206 and the exterior surface 207 of the mandrel 205.

Figure 6:
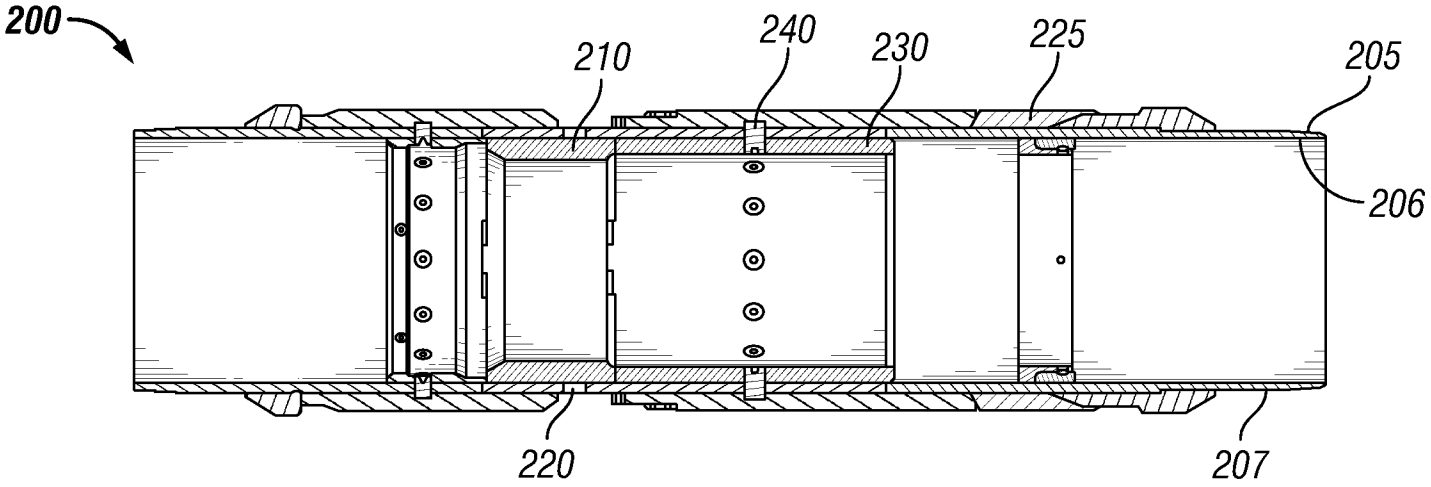
FIG. 6 illustrates a cross-sectional view of a cementing tool in accordance with one or more embodiments of the present disclosure.

With reference now to FIG. 6, another embodiment of the stage tool 200 is illustrated. As illustrated, the components of the stage tool 200 may be designed similar to the embodiment as shown in FIGS. 2-5 except that the present embodiment may not require the plurality of shear pins 233 (referring to FIGS. 2-5) to couple the intermediate sleeve 230 to the opening seat 210. The intermediate sleeve 230 may be coupled to the opening seat 210 by any other suitable means. Alternatively, the opening seat 210 may comprise an extension of material with the plurality of radial setting pins 240 rather than the intermediate setting sleeve 230. In one or more embodiments, as pressure is applied to the stage tool 200, the plurality of radial setting pins 240 may shear after the packer element 225 has been actuated to expand. As the plurality of radial setting pins 240 shear, the opening seat 210 may further translate to allow fluid communication between the interior surface 206 and the exterior surface 207 of the mandrel 205 through the plurality of ports 220. The intermediate sleeve 230 may move or translate in tandem with the opening seat 210 before, after or both the plurality of radial setting pins have sheared.

A method of using the stage tool 200 may involve providing the stage tool 200 as described above, running the stage tool 200 into a wellbore, providing the opening plug 300, disposing the opening plug 300 into the opening seat 210, providing the closing plug 500, and placing the closing plug 500 into the closing seat 215. The stage tool 200 may be run into the wellbore as part of a casing string (for example, tubular 120 shown on FIG. 1) with each of the opening seat 210 and the closing seat 215 in a first position. Thus, the plurality of ports 220 may be covered by the opening seat 210 and not by the closing sleeve 265. Once the stage tool 200 is in the desired location in the wellbore, the opening plug 300 may be dropped into the casing string and run in until it reaches the stage tool 200 and lands on the opening seat 210, as illustrated in FIG. 3. Moving the opening plug 300 into engagement with the opening seat 210 may require application of pressure within the interior of the casing string, which may be in communication with the interior surface 206 of the mandrel 205 of the stage tool 200.

Once the opening plug 300 has landed on the opening seat 210, pressure sufficient to cause the opening seat 210 to move from the first position to the second position may be applied. This pressure may be sufficient to shear a set of shear pins holding the opening seat 210 in engagement with the interior surface 206 of the mandrel 205, allowing the opening seat 210 and the opening plug 300 to move downward. As the opening seat 210 moves downward, the plurality of ports 220 may be uncovered, thereby allowing fluid communication between the interior surface 206 and the exterior surface 207 of the stage tool 200. As the opening seat 210 moves downward, the packer element 225 may be compressed to expand radially to create a seal against the interior surface of the wellbore.

Once the packer element 225 is set, a second stage cementing operation may be performed before disposing the closing plug 500 into the wellbore (for example, a fluid may be introduced to flow through the plurality of ports 220). Such fluid in a second stage cementing operation may include cement or other material intended to be placed between the wellbore and the casing string, above the location of the packer element 225. Once the fluid has been placed between the wellbore and the casing string, the plurality of ports 220 may be blocked or covered through use of the closing plug 500. The closing plug 500 may be dropped into the casing string and pressure applied to cause the closing plug 500 to land on the closing seat 215, as illustrated in FIG. 5.

Once the closing plug 500 has landed on the closing seat 215, pressure sufficient to cause the closing seat 215 to move from the first position to the second position may be applied. This pressure may be sufficient to shear a set of shear pins holding the closing seat 215 in engagement with the interior surface 206 of the mandrel 205, allowing the closing seat 215 and the closing plug 500 to move downward. As the closing seat 215 moves downward, the closing sleeve 265 may be displaced over the plurality of ports 220, preventing further flow of the fluid therethrough.

Once these operations are complete, the opening plug 300, opening seat 210, the closing plug 500, and/or the closing seat 215 may be drilled out.

An embodiment of the present disclosure is a stage tool comprising: a mandrel, an opening seat, a closing seat, a plurality of ports, a closing sleeve, and a packer element, wherein the opening seat is attached to an interior surface of the mandrel, wherein the closing seat is attached to the interior surface of the mandrel, wherein the plurality of ports is configured to allow fluid communication between the interior surface of the mandrel and an exterior surface of the mandrel, wherein the closing sleeve is disposed on the exterior surface of the mandrel and coupled to the closing seat, and wherein the packer element is disposed on the exterior surface of the mandrel.

In one or more embodiments described in the preceding paragraph, the stage tool further comprises an intermediate sleeve coupled to a first end of the opening seat, wherein the opening seat is configured to receive an opening plug at a second end, wherein the second end is opposite to the first end. In one or more embodiments described above, wherein the intermediate sleeve is coupled to the first end of the opening seat through a plurality of shear pins, wherein the intermediate sleeve translates in relation to the opening seat after the plurality of shear pins have been sheared. In one or more embodiments described above, wherein the intermediate sleeve translates in tandem with the opening seat. In one or more embodiments described above, the stage tool further comprises a setting sleeve, wherein the setting sleeve is coupled to the intermediate sleeve through a plurality of radial setting pins, wherein the setting sleeve is configured to translate as the intermediate sleeve translates. In one or more embodiments described above, the stage tool further comprises a ramp, wherein the packer element is disposed between the setting sleeve and the ramp, wherein the ramp comprises a lower centralizer at a distal end of the ramp. In one or more embodiments described above, wherein the closing sleeve is coupled to the closing seat via a plurality of radial closing pins. In one or more embodiments described above, the stage tool further comprises an upper centralizer, wherein the upper centralizer is disposed on the exterior surface of the mandrel about the closing sleeve. In one or more embodiments described above, wherein the closing seat is configured to receive a closing plug at a first end. In one or more embodiments described above, wherein the closing seat is adjacent to the opening seat in a first position, wherein the opening seat blocks the plurality of ports from the interior surface of the mandrel.

Another embodiment of the present disclosure is a method for cementing operations comprises: disposing a stage tool downhole into a wellbore, wherein the stage tool comprises: a mandrel, an opening seat, a closing seat, a plurality of ports, a closing sleeve, and a packer element, wherein the opening seat is attached to an interior surface of the mandrel, wherein the closing seat is attached to the interior surface of the mandrel, wherein the plurality of ports is configured to allow fluid communication between the interior surface of the mandrel and an exterior surface of the mandrel, wherein the closing sleeve is disposed on the exterior surface of the mandrel and coupled to the closing seat, wherein the packer element is disposed on the exterior surface of the mandrel, disposing an opening plug into the wellbore, and disposing a closing plug into the wellbore.

In one or more embodiments described in the preceding paragraph, wherein the opening plug lands onto the opening seat, wherein the opening seat comprises a first end and a second end, wherein the first end is coupled to an intermediate sleeve, wherein the second end is configured to receive the opening plug. In one or more embodiments described above, wherein the intermediate sleeve is coupled to the first end of the opening seat through a plurality of shear pins. In one or more embodiments described above, the method further comprises shearing the plurality of shear pins. In one or more embodiments described above, the method further comprises translating the opening seat and the intermediate sleeve, wherein the intermediate sleeve is coupled to a setting sleeve, wherein the setting sleeve is coupled to the intermediate sleeve through a plurality of radial setting pins, wherein the setting sleeve is configured to translate as the intermediate sleeve translates. In one or more embodiments described above, the method further comprises actuating the packer element to expand in a radial direction to engage the wellbore. In one or more embodiments described above, wherein the closing plug lands onto the closing seat, wherein a first end of the closing seat is configured to receive the closing plug. In one or more embodiments described above, the method further comprises translating the closing seat, wherein the closing seat is coupled to a closing sleeve, wherein the closing sleeve is coupled to the closing seat through a plurality of radial closing pins, wherein the closing sleeve is configured to translate as the closing seat translates. In one or more embodiments described above, wherein the closing sleeve blocks the plurality of ports from the exterior surface of the mandrel after being translated by the closing seat. In one or more embodiments described above, the method further comprises performing a second stage cementing operation before disposing the closing plug into the wellbore.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (for example, "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A stage tool, comprising:

a mandrel;

an opening seat, wherein the opening seat is attached to an interior surface of the mandrel;

a closing seat, wherein the closing seat is attached to the interior surface of the mandrel;

a plurality of ports, wherein the plurality of ports is configured to allow fluid communication between the interior surface of the mandrel and an exterior surface of the mandrel;

an intermediate sleeve coupled to the opening seat through a plurality of shear pins, wherein the intermediate sleeve is disposed within an interior of the mandrel, wherein the intermediate sleeve is configured to translate with the opening seat until the plurality of shear pins have been sheared;

a setting sleeve coupled to the intermediate sleeve, wherein the setting sleeve is disposed external to and around the mandrel, wherein the setting sleeve is configured to translate as the intermediate sleeve translates in response to the opening seat receiving an opening plug;

a closing sleeve, wherein the closing sleeve is disposed on the exterior surface of the mandrel and coupled to the closing seat; and a packer element, wherein the packer element is disposed on the exterior surface of the mandrel.

2. The stage tool of claim 1, wherein the intermediate sleeve is coupled to a first end of the opening seat, wherein the opening seat is configured to receive the opening plug at a second end, wherein the second end is opposite to the first end.

3. The stage tool of claim 1, wherein the setting sleeve is coupled to the intermediate sleeve through a plurality of radial setting pins.

4. The stage tool of claim 1, further comprising a ramp, wherein the packer element is disposed between the setting sleeve and the ramp, wherein the ramp comprises a lower centralizer at a distal end of the ramp.

5. The stage tool of claim 1, wherein the closing sleeve is coupled to the closing seat via a plurality of radial closing pins.

6. The stage tool of claim 1, further comprising an upper centralizer, wherein the upper centralizer is disposed on the exterior surface of the mandrel about the closing sleeve.

7. The stage tool of claim 1, wherein the closing seat is configured to receive a closing plug at a first end.

8. The stage tool of claim 1, wherein the closing seat is adjacent to the opening seat in a first position, wherein the opening seat blocks the plurality of ports from the interior surface of the mandrel.

9. The stage tool of claim 1, further comprising a plurality of outer channels disposed about the mandrel, wherein the plurality of outer channels limit the distance the opening seat travels as the ends of each one of the plurality of outer channels prohibit further movement of the intermediate sleeve.

10. A method for cementing operations, comprising:

disposing a stage tool downhole into a wellbore, wherein the stage tool comprises:

a mandrel;

an opening seat, wherein the opening seat is attached to an interior surface of the mandrel;

a closing seat, wherein the closing seat is attached to the interior surface of the mandrel;

a plurality of ports, wherein the plurality of ports is configured to allow fluid communication between the interior surface of the mandrel and an exterior surface of the mandrel;

an intermediate sleeve coupled to the opening seat through a plurality of shear pins, wherein the intermediate sleeve is disposed within an interior of the mandrel, wherein the intermediate sleeve is configured to translate with the opening seat until the plurality of shear pins have been sheared;

a closing sleeve, wherein the closing sleeve is disposed on the exterior surface of the mandrel and coupled to the closing seat; and a packer element, wherein the packer element is disposed on the exterior surface of the mandrel;

disposing an opening plug into the wellbore;

translating the opening seat and the intermediate sleeve in response to the opening seat receiving the opening plug, wherein the intermediate sleeve is coupled to a setting sleeve, wherein the setting sleeve is disposed external to and around the mandrel, wherein the setting sleeve is configured to translate as the intermediate sleeve translates; and disposing a closing plug into the wellbore.

11. The method of claim 10, further comprising shearing the plurality of shear pins.

12. The method of claim 10, wherein the setting sleeve is coupled to the intermediate sleeve through a plurality of radial setting pins.

13. The method of claim 10, further comprising actuating the packer element to expand in a radial direction to engage the wellbore.

14. The method of claim 10, wherein the closing plug lands onto the closing seat, wherein a first end of the closing seat is configured to receive the closing plug.

15. The method of claim 14, further comprising translating the closing seat, wherein the closing seat is coupled to the closing sleeve, wherein the closing sleeve is coupled to the closing seat through a plurality of radial closing pins, wherein the closing sleeve is configured to translate as the closing seat translates.

16. The method of claim 15, wherein the closing sleeve blocks the plurality of ports from the exterior surface of the mandrel after being translated by the closing seat.

17. The method of claim 10, further comprising performing a second stage cementing operation before disposing the closing plug into the wellbore.

18. The method of claim 10, wherein the stage tool further comprises a ramp, wherein the packer element is disposed between the setting sleeve and the ramp, wherein the ramp comprises a lower centralizer at a distal end of the ramp.

19. The method of claim 18, further comprising displacing the packer element over the ramp and against a shoulder of the lower centralizer.

20. The method of claim 10, wherein the stage tool further comprises a plurality of outer channels disposed about the mandrel, wherein the plurality of outer channels limit the distance the opening seat translates as the ends of each one of the plurality of outer channels prohibit further movement of the intermediate sleeve.

* * * * *